United States Patent [19]

Schmidt et al.

[11] Patent Number: 4,491,252

[45] Date of Patent: Jan. 1, 1985

[54] DISPENSING DEVICE

[75] Inventors: Paul R. Schmidt, Marshall, Mich.; Nelson J. Beall, St. Michael, Minn.

[73] Assignee: General Mills, Inc., Minneapolis, Minn.

[21] Appl. No.: 385,738

[22] Filed: Jun. 7, 1982

[51] Int. Cl.[3] ..... B67D 3/00

[52] U.S. Cl. ..... 222/531; 222/545; 220/254; D9/449

[58] Field of Search ..... 222/531, 534, 535, 536, 222/533, 538, 545, 480, 556; 220/254, 338; 229/7 R; D9/449

[56] References Cited

U.S. PATENT DOCUMENTS

| | | | |
|---|---|---|---|
| 2,777,615 | 1/1957 | De Shazor | 222/480 |
| 2,786,612 | 3/1957 | Gallo | 222/531 |
| 3,217,949 | 11/1965 | Davis | 222/545 |

FOREIGN PATENT DOCUMENTS

| | | | |
|---|---|---|---|
| 204248 | 1/1955 | Australia | 222/531 |
| 1086229 | 8/1954 | France | 222/531 |

*Primary Examiner*—H. Grant Skaggs

*Attorney, Agent, or Firm*—Gene O. Enockson; John A. O'Toole

[57] ABSTRACT

Disclosed are dispensing devices including an attachable dispensing lid adapted to be fitted to the open end of a package for particulate material especially ready-to-eat cereals. The dispensing device not only aids dispensing the particulate contents but also provides a good seal against moisture pickup. The dispensing lid includes a cover member having a peripheral groove which is adapted to frictionally engage the folded portion of the package formed by folding back the package top end flaps and the inner liner. The dispensing lid further comprises a spout member pivotably positioned within a corresponding opening in the cover member.

6 Claims, 6 Drawing Figures

DISPENSING DEVICE

BACKGROUND OF THE INVENTION

1. Field of the Invention

The present invention relates to dispensing devices. More particularly, the present invention relates to dispensing lids which can be snugly fitted over the top of a disposable box of particulate material, e.g., ready-to-eat cereals.

2. The Prior Art

Conventionally, certain moisture sensitive, particulate products, e.g., R-T-E cereals, snacks, soap powders, have been packaged in a cardboard box with an inner liner. The liner is sealed to protect the contents from picking up moisture which may cause the contents to stick to each other, to stale, to cake or otherwise to be adversely affected. Presently, particularly for R-T-E cereals, many packages include a reclosable top and a sealed liner. The liner can be a glassine bag, wax paper, polyolefin etc. with varying constructions and having varying degrees of ease and effectiveness of reseal against moisture after opening. Such packages are inexpensive and widely used. However, such packages also suffer limitations in the effectiveness of both dispensing the particulate materials and protecting the packaged material against moisture pickup once opened. Thus, it would be desirable to provide a device which can be resealed relatively well so as to prevent moisture pickup. Additionally, it would be desirable to provide a package which dispenses the contents in a convenient manner as well as which can be closed to prevent annoying spillage if upset.

Several approaches have been taken in the art to provide devices which both easily dispense and reseal. For example, a wide variety of packaging having dispensing devices are known in the art for particulate materials which are suitable for use when packaged in a box alone without a liner. (See, for example, U.S. Pat. No. 3,036,746 issued May 29, 1962 to K. R. Hagen and U.S. Pat. No. 2,939,617 issued June 7, 1960 to W. S. Hassler.) However, most devices are unsuitable for use when the package includes an inner liner due to difficulties in having access to the liner, resealing the liner, etc.

Other art attempts at providing devices useful for both dispensing and sealing have included, for example, providing reusable plastic containers comprising a plastic lid and a plastic body into which the entire contents of the original package are transferred. Such containers are effective to both dispense and provide moisture protection by virtue of the relatively good seal possible between the plastic pieces. Such devices, however, suffer from several disadvantages. First, a complete second container is required while the original package is discarded. Second, a transfer of the particulate material is required which is not only inconvenient but also can lead to product spillage, breakage, etc. A third disadvantage resides in the absence of flexibility. Clearly, the opening will desirably vary in shape and dimension depending on the material to be dispensed. A separate, possibly large container is required for each material to be dispensed. Additionally, package content recognition is impaired since the containers are not generally transparent and do not contain the original package brand names, art work, etc.

Another approach taken in the past is to provide box covers which can be fitted over the top of a disposable box of particulate material (see, for example, U.S. Pat. No. 2,786,612 issued Mar. 26, 1967 to N. D. Gallo). However, the dispensing device disclosed therein is adapted to be used specifically in combination with a box opened by the removal or perforation of the corner of the box, rather than the folding back of top cover flaps. Moreover, the device is not designed to be used in combination with a box provided with a liner.

Given the state of the art as described above, there is a continuing need for new dispensing devices useful to provide both dispensing and sealing means for packages of particulate materials having inner linings. Accordingly, it is an object of the present invention to provide dispensing devices which can be used with conventional packages which not only conveniently dispense particulate material but also provide good sealage protection against moisture pickup.

It is another object of the present invention to provide a new form of box cover or dispensing lid which can be fitted snugly over the top of a disposable box or carton which has been opened by folding back the top flaps, desirably also of the liner, so that the lid serves as a closure for the box when not in use, and as a dispensing spout or pouring aid to direct the dispensed material into a confined stream when poured from the box.

Another object of the present invention is the provision of a box or cover and dispensing device of simple but effective construction which may be inexpensively molded or fabricated from plastic material enabling the device to be produced at such low cost as to offer a commercially attractive solution to existing problems of handling and storage of opened boxes of R-T-E cereals or other particulate material.

Still another object is to provide an effective dispensing device so inexpensive to produce that the products can be given away as advertising items or premiums or sold at modest costs.

DESCRIPTION OF THE PREFERRED EMBODIMENTS

Figure 1:
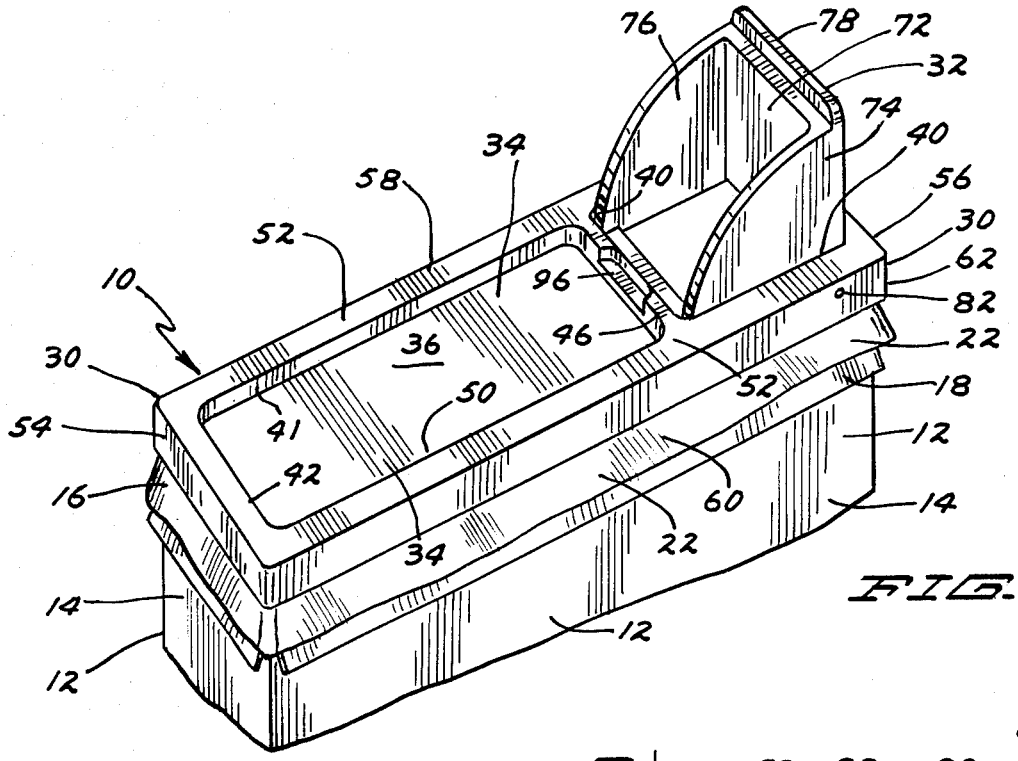
FIG. 1 is a fragmentary perspective view of the dispensing device showing the device fitted over the end of a box whose contents are to be dispensed and showing the pouring spout of the device in a fully opened position.

Referring now to the drawings, and to FIG. 1 in particular, there is shown an embodiment of the present dispensing lid which is designated generally by reference numeral 10. The dispensing lid 10 is used, generally, in combination with a carton or package member 12. As conventionally constructed in the R-T-E cereal package art, the carton 12 includes a body 14 member, a pair of end flaps 16 and a pair of side flaps 18. The cereal package can also include an inner liner 22. The carton 12, in this instance, can be formed of cardboard material or the like. When the end and side flap members and liner are folded over the sides of the body 14 forming a fold 24, a box orifice or opening 26 (seen in FIG. 3) is defined.

As seen in FIG. 1, the dispensing lid 10 comprises a cover member 30 and a closure member 32. The cover member 30 includes a flat rectangular panel or planar member 34 having a top surface 36 and a bottom surface 38, (FIG. 4) and an opening or aperture 40. The top surface 36 is surrounded by a vertical wall 41 including an opposed pair of vertically oriented inner side walls 48 and 50 as well as an opposed pair of vertically oriented inner end walls 42 and 44 (FIG. 3) each upstanding from the panel 34. Upstanding from the panel 34 also is a transverse or dividing wall 46 intermediate the end walls 42 and 44. The rectangular aperture 40 commences at end wall 44 and extends inwardly to the intermediate dividing wall 46. The cover member 30 additionally includes a second upper or top planar member 52 spaced above and parallel to the panel 34. Depending vertically from the top planar member 52 are an opposed pair of outer end walls 54 and 56, which depend parallel to inner end walls 42 and 44 respectively, as well as an opposed pair of outer side walls 58 and 60 which depend parallel to inner side walls, 48 and 50 respectively. Together, the outer side and end wall members define a skirt 62 which extends around the entire periphery of the cover member 30. As can be better seen in FIG. 3, the skirt 62 extends downwardly beyond the bottom surface 38 of panel 34. As can be seen, the various members of the cover member 30 can be formed integral with one another such as by an injection molding operation, or less desirably, by cementing one to another so that a unitary cover member is formed thereby.

Figure 3:
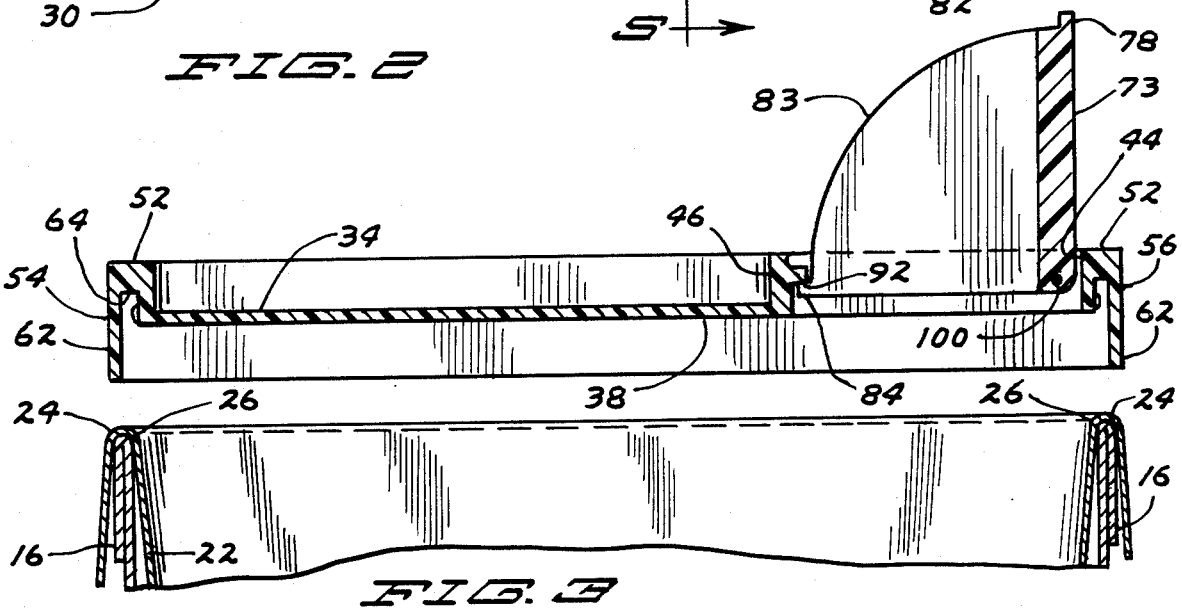
FIG. 3 is a fragmentary sectional view taken along lines 3—3 of FIG. 2 showing the dispensing lid disengaged from the box.
Figure 4:
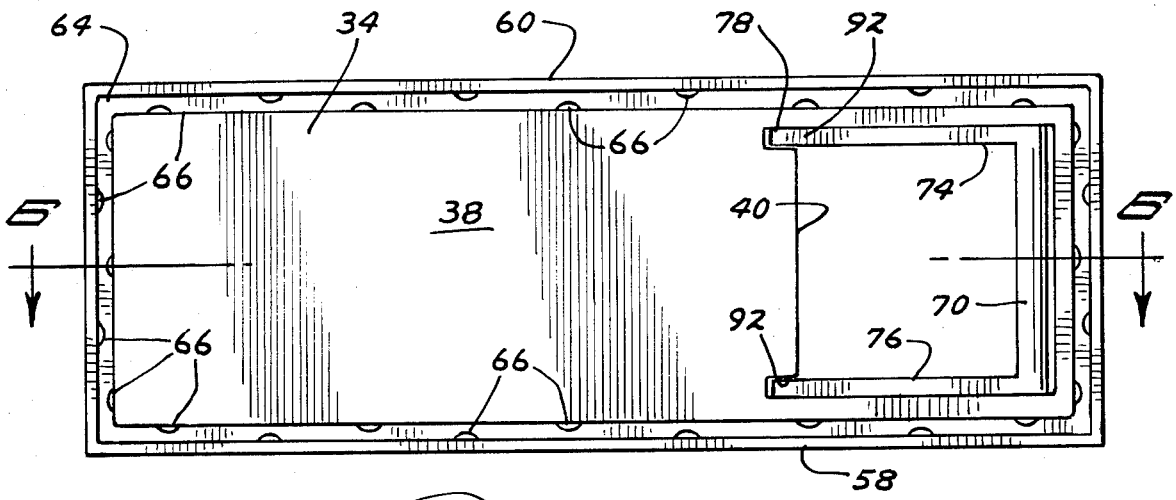
FIG. 4 is a plan view of the bottom of the dispensing lid with the spout in an open position.
Figure 5:
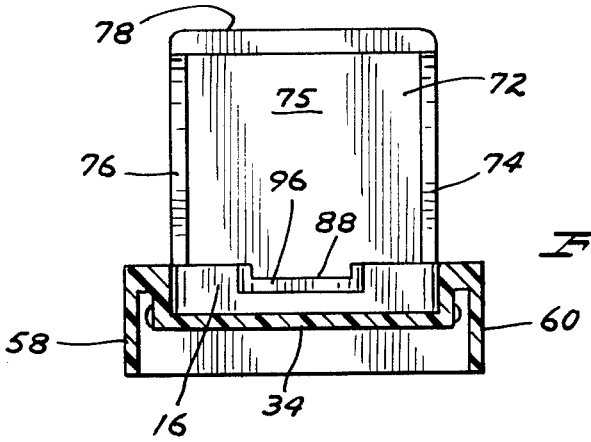
FIG. 5 is a sectional view of the dispensing lid taken along lines 5—5 of FIG. 2.

Referring now briefly to FIG. 4, it can be seen that the inner and outer side and end wall members together define a peripheral groove 64 around the panel 34. Referring now to FIG. 3, it is seen that the peripheral groove 64 is adapted to frictionally engage the folded or crimped portion 24 of the carton 12. The width, depth, and angle of the peripheral groove 64 is such that a firm friction fit is obtained. Referring once again to FIG. 4, it can be seen that in the most preferred embodiment, the peripheral groove 64 is provided with a plurality of protuberances 66 spaced around the peripheral groove 64 which aid in providing a friction fit. If desired, any or all of these wall and side members can be provided with protuberances which project therefrom. Desirably, the friction fit prevents accidental disassembly of the dispensing lid 10 from the carton even when shaken vigorously in use.

Referring once again to FIG. 1, it can be seen that the closure member 32 is formed with a rectangular portion 72, having a top surface 73 (FIG. 3) and a bottom surface 75, and an opposed pair of quadrantal side walls 74 and 76. The rectangular surface has an extruding or projecting lip or tab 78 opposite the pivotal axis (described below) to facilitate manipulation of the closure member from a closed to an open position.

Figure 2:
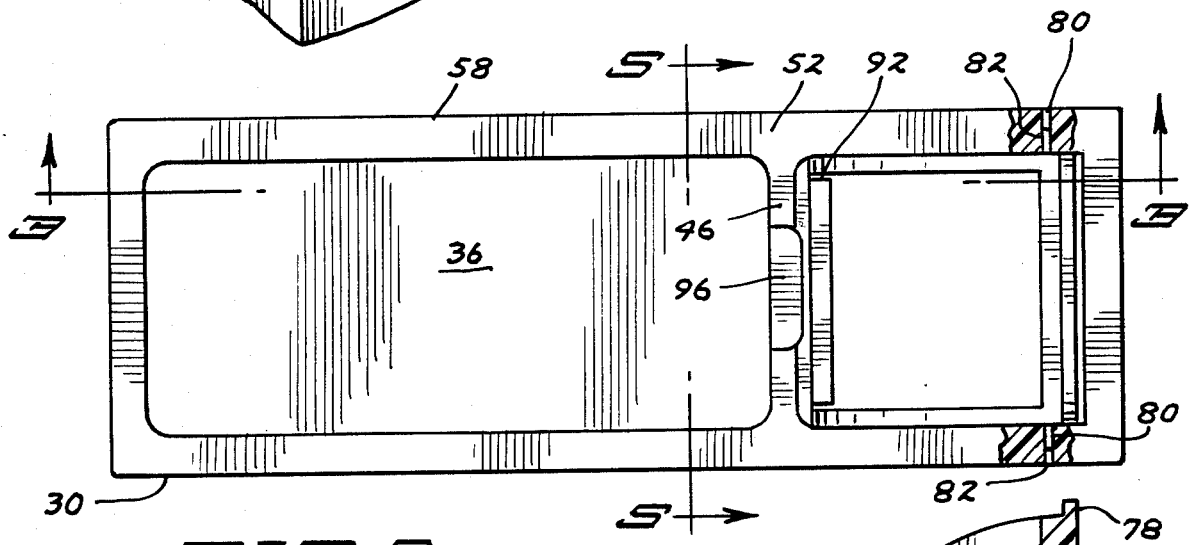
FIG. 2 is a top plan view of the dispensing lid with the pouring spout in a fully opened position.

Referring now to FIG. 2, it is seen that the closure member 32 is pivotably mounted on the cover member 30 in the aperture 26 with means for pivoting the closure member 70 which, for example, can include an opposed pair of pivot pins 80 which are journaled in a pair of opposed pivot bores 82 in the cover member 30.

Figure 6:
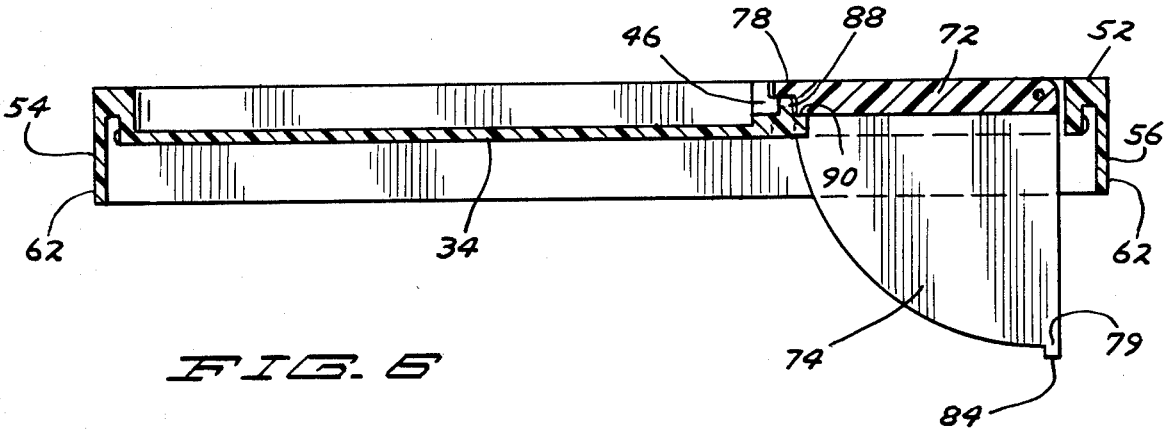
FIG. 6 is a sectional view of the dispensing lid taken along lines 6—6 of FIG. 3 showing the spout in a closed position.

As can be seen in FIG. 3, the closure member 32 has side walls each having a curved edge 83 and a projecting lug 84 adjacent the free edge of the sides, i.e., opposite the pivotal axis 100, which are adapted to function as a stop so as to prevent opening of the spout beyond a certain point. As seen in FIG. 6, if desired, a portion 79 of the quadrantal members 74 and 76 proximate the lugs 84 can be extended slightly beyond a perfect arc to provide for friction engagement with the dividing wall 46. Such a construction provides for a friction lock function for the closure member 70 in an open position.

As illustrated in FIG. 6, the dividing wall is constructed so as to engage with the closure member to provide a closed or sealed opening. Specifically, and as better seen in FIG. 2, the transverse wall 46 is fabricated with a first, recessed stop surface 88 which is adapted to form a stop for the lip 78 so as to prevent closing or pivoting of the closure member 70 beyond a certain position. The recession of the first stop surface 88 is dependent upon the thickness of the lip so as to allow closure of the closure member such that when fully closed the rectangular portion 72 is in substantially the same plane as the upper planar member 52.

The dividing wall 46 further includes a second recessed stop surface 90 which is similarly adapted to form a stop for the bottom surface 75 to prevent excessive pivoting of the closure member as well as to provide a better moisture seal. As seen in FIGS. 2 and 4, the second stop surface is also provided with a pair of spaced notches 92 through which pass the quadrantal sides 74 and 76. As seen in FIG. 3, the dividing wall 46 is fabricated with a spaced pair of opposed lug notches 92 when closure member 72 is in an open position, the lugs 84 nest in the lug notches 92.

Additionally, as best seen in FIG. 2, the dividing wall 46 is fabricated with a notched portion 96 which facilitates finger engagement of the lip 78 when the closure member 70 is in the closed position.

In a typical manner of use, it is contemplated that the consumer will open a package of material and fold back both the end and side flaps as well as the liner. A dispensing lid of the present invention will then be fitted onto the box orifice so provided such that a secure engagement is obtained. Thereafter, the spout can be operated from a closed to open position by finger engagement with the peripheral fringe tab. In an opened position the spout serves to dispense the packaged contents in a controlled manner. The spout can then be pivoted to a closed position to provide a closure which provides good sealing to prevent moisture pickup.

Of course, while the above description of the invention has been made with reference to the preferred embodiment, the invention is not limited thereto. For example, while a rectangular dispensing lid has been specifically described, for other products typically packaged in cylindrical packages, e.g., rolled oats, a circular dispensing lid within the scope of the present invention would be employed.

What is claimed is:

1. A dispensing lid for use in dispensing particulate material from a box having a rectangular orifice defined by the fold formed by folding back closure end and side flaps and an inner liner, said lid comprising:

a cover member, said cover member including a first planar member having a top surface and a bottom surface.

an upstanding vertical wall surrounding said top surface, said wall including a first end wall and a second end wall, a transverse upstanding wall intermediate said first and second end walls defining an interior wall, an opening running inwardly from said first end wall to said transverse wall, a second planar member spaced above said vertical wall and in a plane parallel to the plane of said first planar member, said second member extending outwardly from said vertical wall; a skirt extending downwardly from said second planar member surrounding the periphery of said first planar member defining a peripheral groove around said first planar member;

a closure member; and means for pivotably mounting the closure member on the cover member in the opening, wherein the means for pivotably mounting the closure member on the cover member includes providing an opposed pair of pivot bores in said vertical wall intermediate said first end wall and said transverse wall and wherein the closure member includes a pair of opposed pivot pins projecting laterally from the sides of the closure member journaled in said pivot bores forming a pivot axis, wherein the pivot bores are positioned proximate the first end wall, wherein the opening is rectangular and wherein said closure member comprises a rectangular portion having a top surface and a bottom surface, an opposed pair of quadrantal members depending from the bottom face of said rectangular portion and wherein such quadrantal members include a stop lug opposite the pivot axis, wherein said interior wall includes a first stop surface proximate said opening, said first stop surface being recessed from the plane of the second planar member an amount such that the rectangular portion is in the same plane as the second planar member when the closure member is in a closed position and the rectangular portion is in contact with the first stop surface.

2. The dispensing lid of claim 1 wherein the cover member includes a plurality of protuberances in the peripheral groove.

3. The dispensing lid of claim 2 wherein the closure member further includes a peripheral fringe tab projecting outwardly from the rectangular portion opposite the pivotal axis.

4. The dispensing lid of claim 3 wherein the lid member includes a second stop surface projecting outwardly into said opening, said second stop surface being recessed from the plane of the second planar member such that the rectangular portion is in the same plane as the second planar member when the closure member is in a closed position and the rectangular portion is in contact with the second stop surface.

5. The dispensing lid of claim 4 wherein the first planar member is rectangular.

6. The dispensing lid of claim 5 wherein the closure member includes means for locking the closure member in an open position.

* * * * *